US006206373B1

(12) United States Patent
Garrod

(10) Patent No.: US 6,206,373 B1
(45) Date of Patent: Mar. 27, 2001

(54) METHOD OF AND APPARATUS FOR PLAYING A CARD GAME

(76) Inventor: Glen E. Garrod, 17750 Rock Creek, Nevada City, CA (US) 95959

( * ) Notice: Subject to any disclaimer, the term of this patent is extended or adjusted under 35 U.S.C. 154(b) by 0 days.

(21) Appl. No.: 09/249,663

(22) Filed: Feb. 12, 1999

Related U.S. Application Data

(60) Provisional application No. 60/074,904, filed on Feb. 17, 1998, and provisional application No. 60/088,534, filed on Jun. 8, 1998.

(51) Int. Cl.[7] ..... A63F 1/00; A63F 13/00
(52) U.S. Cl. ..... 273/292; 463/13
(58) Field of Search ..... 273/292; 463/12, 463/13

(56) References Cited

U.S. PATENT DOCUMENTS

| | | | | |
|---|---|---|---|---|
| 4,836,553 | | 6/1989 | Suttle et al. | 273/292 |
| 4,861,041 | | 8/1989 | Jones et al. | 273/292 |
| 4,948,134 | | 8/1990 | Suttle et al. | 463/13 |
| 5,022,653 | | 6/1991 | Suttle et al. | 463/13 |
| 5,078,405 | | 1/1992 | Jones et al. | 273/309 |
| 5,275,411 | | 1/1994 | Breeding | 273/149 R |
| 5,320,356 | * | 6/1994 | Cauda | 273/292 |
| 5,374,067 | | 12/1994 | Jones | 273/292 |
| 5,377,973 | | 1/1995 | Jones et al. | 273/292 |
| 5,380,012 | | 1/1995 | Jones et al. | 273/292 |
| 5,382,025 | | 1/1995 | Sklansky et al. | 273/292 |
| 5,437,462 | | 8/1995 | Breeding | 273/292 |
| 5,531,448 | * | 7/1996 | Moody | 273/292 |
| 5,544,892 | | 8/1996 | Breeding | 273/292 |
| 5,653,444 | | 8/1997 | Dahl | 273/274 |
| 5,664,781 | | 9/1997 | Feola | 273/292 |
| 5,707,286 | | 1/1998 | Carlson | 463/16 |
| 5,711,525 | | 1/1998 | Breeding | 273/292 |
| 5,725,216 | | 3/1998 | Jones | 273/292 |
| 5,762,340 | | 6/1998 | Feola | 273/292 |
| 5,820,128 | * | 10/1998 | Brunelle | 273/292 |

OTHER PUBLICATIONS

Gensler, Howard, "Inside Straight," Individual Investor, p72, Apr. 1998.
Play card for "Caribbean Stud Poker" from Bally's Las Vegas (2 pages).
Play card for "Let it Ride" from Bally's Las Vegas (2 pages).
"How to Play Casino Poker–Texas Hold–em" by Victor H. Royer. www.vegas.com/vegascom/betbasc/holdem.htm. Jul. 1996.*

* cited by examiner

*Primary Examiner*—Benjamin H. Layno
(74) *Attorney, Agent, or Firm*—Keith G. Askoff

(57) ABSTRACT

Methods of and apparatuses for playing a card game. In one method, the dealer's hand contains a specified card, such as e.g. the ace of spades, that is displayed face up. From the remainder of the deck each player is dealt two face down cards. After viewing the two face down cards, each player may act upon his or her hand. The player may be given the option to fold and receive a portion of the original wager back. Alternatively, the player may remain in the game leaving the original wager unchanged. As a further alternative, the player may be given the option to increase the wager up to a determined amount. After making a decision, the five common cards are dealt face up. The common cards are common to each of the players' hands and to the dealer's hand. The dealer is then dealt one card face up to complete the deal. Each player compares his or her best five card hand to the dealer's best five card hand to determine if that player is a winner. Additionally, the player may receive a bonus for certain hands. Further, the player may fold and receive a return based on some portion or all of the wager for having one or two of a predetermined card (such as a deuce) in the player's initial two cards.

34 Claims, 5 Drawing Sheets

METHOD OF AND APPARATUS FOR PLAYING A CARD GAME

This application claims benefit and priority of provisional application Ser. No. 60/074,904, filed Feb. 17, 1998 and of provisional application Ser. No. 60/088,534, filed Jun. 8, 1998, both of which provisional applications are hereby incorporated in their entirety herein by reference.

FIELD OF THE INVENTION

The present invention relates to the field of card games, and more particularly to a card game that may be played player versus the dealer and in which the dealer may have a hand comprising a predetermined card.

BACKGROUND OF THE INVENTION

Poker is one of the oldest gambling card games in America. Traditionally it has been played in casinos, card rooms, clubs and homes throughout the country. In recent years there have been considerable variations and improvements in games. Many new games use poker as their basis. For example, in the casino "live" gaming areas, games such as "Caribbean Stud," "Pai Gow" and "Let It Ride" are becoming increasingly popular, and displacing older standards such as blackjack, roulette and craps. These newer games are all based on poker hands using poker rankings. In addition to the new games, new technology is taking advantage of the interest in poker. For example, video poker machines, which may use standard poker or a variation of it, are taking up the casino space previously occupied by old "one armed bandits" or multi-reel slot machines. All of the foregoing attests to the popularity of, and interest in, poker.

One of the most popular poker games is "Texas Holdem." The annual World Series of Poker at Binion's Horseshoe in Las Vegas, Nev. uses No Limit Texas Holdem to determine the World Champion. The game starts with each player being dealt two cards face down. A first betting round follows the deal of the two face down cards. In the betting round, a player may pass or may make the initial bet. Once a bet has been made by a player, other players may call the bet, raise the bet, or fold the hand. The betting continues until there are no further raises, and all players have either called the last bet or folded. Next, three common cards, so named because they are common to all hands, are dealt face up. The players again evaluate their hands, each player using his or her two face down cards, together with the three common cards. A second betting round ensues. Next, a fourth common card is dealt face up, followed by a third betting round. Finally, a fifth common card is dealt face up, followed by a fourth betting round. The hands of all players remaining—i.e. all players who did not fold in any of the betting rounds—are compared. The winner is the player who achieves the highest hand according to standard poker rankings: royal flush, straight flush, four of a kind, full house, flush, straight, 3 of a kind, two pair, one pair, high card. The winner takes the pot.

While games such as the above described game of Texas Holdem are popular, there are a number of drawbacks. One problem for commercial gaming establishments is that the game is player versus player, as opposed to player versus the house. This means that the house must collect a percentage of the pot to make a profit. Because each hand can take a considerable amount of time, given the number of betting rounds and the time inherent in bluffing, attempting to "read" other players, and so on, the profit margin for the house is limited. In addition, many would-be customers are simply too intimidated to play against other players, especially in light of the fact that the other players may be professional card players with considerable experience.

What is needed is a game that may be based on poker but that may be played player versus the dealer. It is further desirable that player actions such as increasing the bet and folding the hand can be performed without time consuming bluffing and attempting to read other players, to provide acceptable turnaround time per hand to allow for improved profit margin. It is further desirable that the game is not intimidating to new or inexperienced players. It is further desirable that the game maintain some elements of successive betting, and have a method of play and payout structure that maintains player interest.

SUMMARY OF THE INVENTION

The present invention provides a game that uses, in one preferred embodiment, a standard deck of cards, optionally an additional card with certain attributes and standard poker rankings. In one embodiment each player's hand comprises one or more individual cards, together with one or more common cards. The dealer's hand comprises one or more individual cards, together with the aforementioned common cards. In a preferred embodiment, the dealer's hand comprises a "permanent" card, which may be the aforementioned additional card, for example.

The embodiments of the present invention may provide one or more advantages including providing a new and challenging form of gaming entertainment to casino customers; providing a form of poker that may be played player versus dealer rather than player versus player; providing a means for increasing the speed of playing poker so that the house may achieve an acceptable return; and providing a form of poker that can attract new players.

The foregoing and other benefits of the inventions will become apparent from the present specification.

DETAILED DESCRIPTION OF THE PRESENT INVENTION

In a preferred embodiment, the present invention utilizes a standard deck of poker cards having four suits, each having 13 cards ranking 2–10, jack, queen, king and ace (with the ace having the option of being played low, as is standard.) and, in a preferred embodiment, an additional "ace of all suits." As will be described in detail below, in a preferred embodiment, each player's hand will consist of two face down cards, together with, in one embodiment, five face up common cards—i.e. common to each player and to the dealer, while the dealer's hand consists in one embodiment of the same five common cards together with a face down card and the aforementioned ace of all suits as a "permanent" card. Each player utilizes these seven cards to make the best five card hand using the earlier mentioned rankings—royal flush, straight flush, four of a kind, full house, flush, straight, three of a kind, two pairs, one pair, high card. Each player's hand is then compared to the dealer's hand (but not to the other player's hands) to determine if the player has a winning hand.

Figure 1:
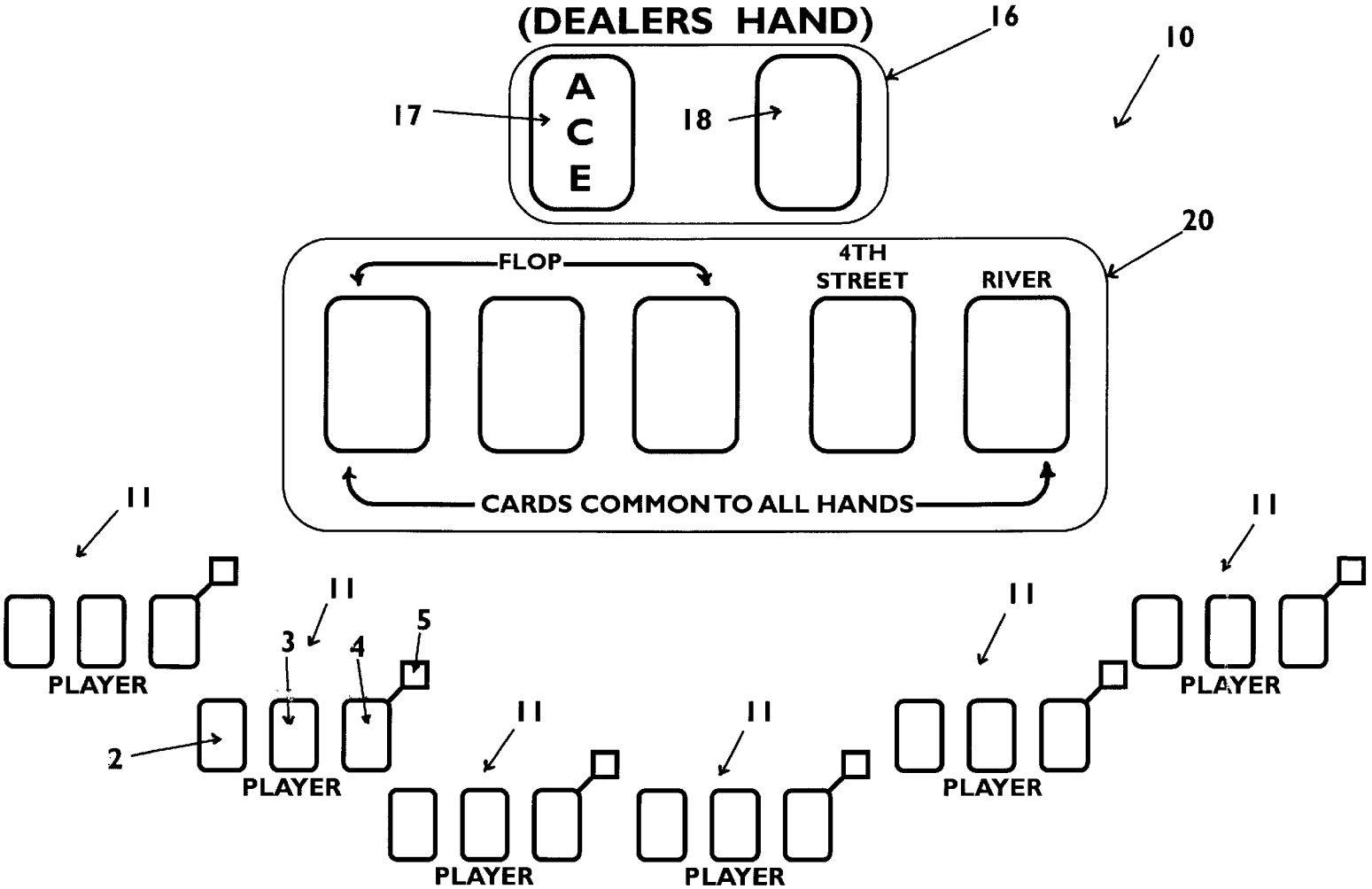
FIG. 1 shows an illustration of the playing field in a preferred embodiment of the present invention.
Figure 2:
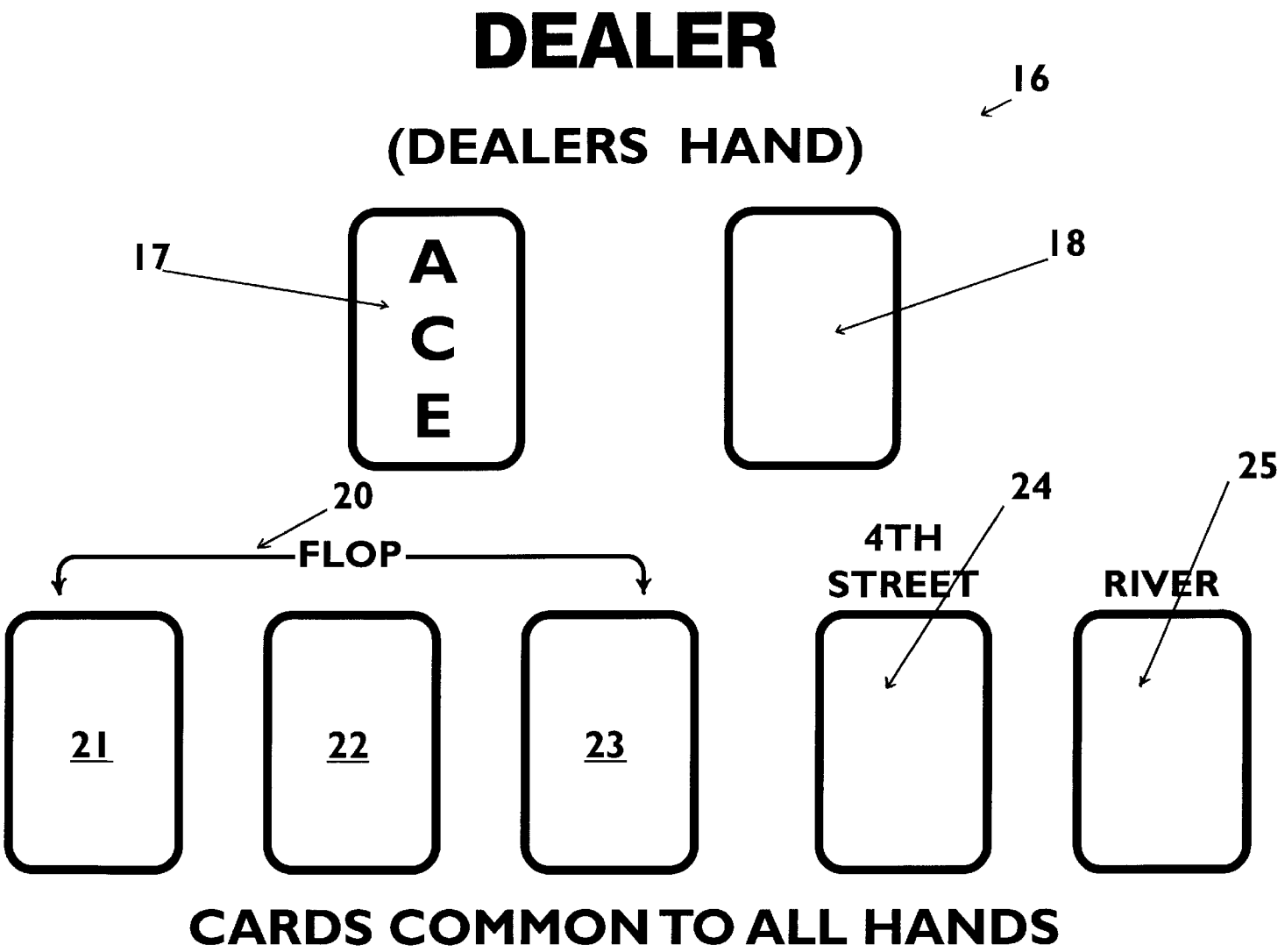
FIG. 2 is an enlarged view of a portion of the playing field of FIG. 1 showing the dealer's hand and the common card area.
Figure 3:
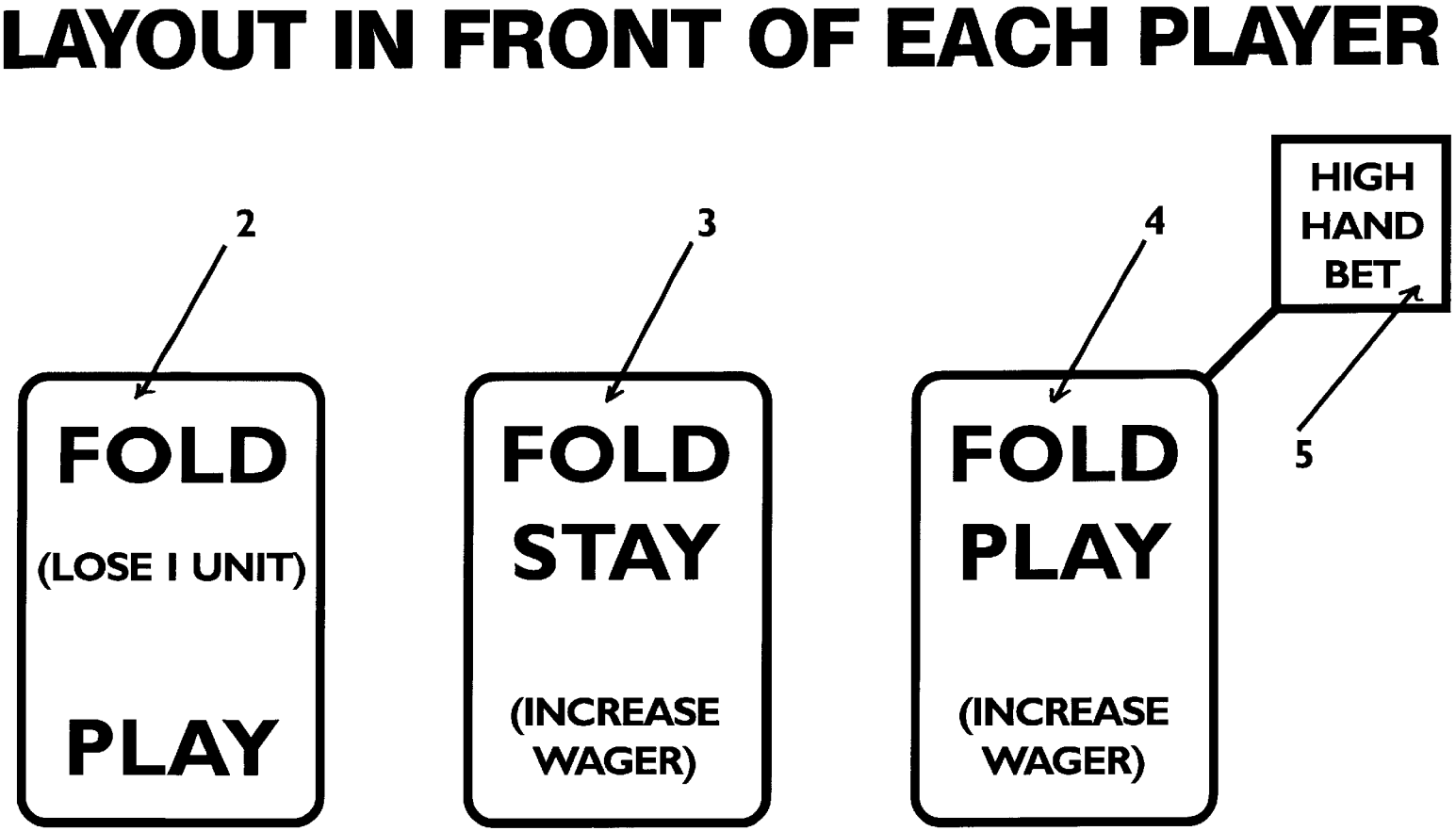
FIG. 3 is an enlarged view of a portion of the playing field of FIG. 1 showing one of the player positions.

FIG. 1 shows a playing field 10 having multiple player positions 11, each having in one embodiment four wager or bet squares 2 through 5. Also shown is dealer's hand 16, comprising cards 17 and 18, and common area 20. FIG. 2 shows an enlarged view of the dealer's hand 16 and common area 20, while FIG. 3 shows an enlarged view of the player position 11.

The minimum and maximum wager may be set at any desired value. Herein, wagers and payouts will be expressed in units to provide illustrative embodiments of the relative value of the various bets and payouts of the present invention. In general, these illustrative embodiments may specify that a player may, for example, ante a specified number of units and may increase a specified number of units. As will become apparent, these illustrative embodiments may be varied. Moreover, it will be appreciated that even when a specific embodiment is chosen, one player's wager may be different from another player's wager so long as each player satisfies the ratio of the specific embodiment and any applicable minimum and maximum wager. As one example, if an embodiment provides for an ante of one unit, a bet of two units, and a maximum increase of three units, a first player may ante one dollar, bet two dollars, and increase up to three dollars; a second player may ante two dollars, bet four dollars and increase up to six dollars, provided that both player's bets are within the house minimum and maximum limits.

As will be described later, the relative amounts of wagers and payouts should be designed to provide for a reasonable return for the house, while providing a level and frequency of return to maintain player interest. It is to be understood that the player's wager may be (or may represent) money, or may be points or tokens for recreational play. It will be appreciated that in the case of recreational play, the wagers and payouts need not be structured such that the house achieves an acceptable margin, although it is generally desirable that the odds are about even or slightly in favor of the house to provide a competitive challenge. It will further be appreciated that variations may be made to the exemplary embodiments described herein.

For example, it will be appreciated that allowing a player to increase the bet at some decision point in the game is similar to requiring a larger initial bet and allowing the player to receive a return of a portion of the initial bet upon forfeiting at that same point. To illustrate this, a first embodiment may require an ante of one unit and may allow a raise of one unit at a given point. A second embodiment may require an ante of two units and allow a player to forfeit at the same point and receive one unit upon forfeit. The two embodiments are similar inasmuch as in the event the player loses, the loss may be only a single unit in both (assuming that the player in the second embodiment forfeits at the decision point). Of course, one difference is that in the first embodiment where the increase is optional, the player can continue playing without betting more than the initial one unit wager, whereas in the second embodiment the player must have two units at risk to continue playing past the decision point. As a further illustration, a third embodiment that would be equivalent to the second embodiment, but that would have an increase in place of the unit returned upon forfeit proceeds as follows: the player antes one unit. At the given point, the player must increase by one unit to continue. If the player chooses not to increase, the player is deemed to have forfeited and loses the ante of one unit.

In any event, the foregoing is meant to illustrate the various methods of wagering, and is not meant to be limiting as to the number of units for, or presence or absence of, ante, bet, optional increase, required increase, and return upon forfeit. Nor should it be implied that only one such wagering method can be used at a given point. Thus, although specific embodiments of the invention are described using a method wherein the player initially places a plurality of units in different squares (some of which units may be returned at various points upon forfeit), it will be appreciated that in any embodiment of the invention, any combination of one or more of: required increase, optional increase, portion of the bet returned upon forfeiting can be used at any decision point.

Often any amount that the player must put up and that in most cases is not returned even if player forfeits may be referred to as the "ante" and other amounts that the player may optionally put up and/or which are returned upon forfeit may be referred to as a "bet" or "wager." Herein, for convenience these terms may be used interchangeably, and no inference is to be drawn from the particular nomenclature used. In practice, the various squares described herein may, however, be labeled according standard nomenclature according to the rules used for a particular wager in any embodiment.

It will be appreciated that in some cases, it may be desirable to adjust the game (as will be discussed in more detail later) so that it conforms with varying regulations from jurisdiction to jurisdiction. For example, some jurisdictions do not allow games where the house has a percentage advantage, but rather must take a fixed fee per hand. In such a case, the game is often banked by a player-banker and not the house, and provision is made to require each player to put up some amount as part of the "rake" which is taken by the house each hand. The player-banker takes the position of the dealer (although the physical dealing of cards and collection of wagers from losers and payments to winners is usually done by an employee of the house). Some establishments may still wish to provide an advantage to the player-banker to provide an incentive for players to act as player-banker. However, some establishments may desire to reduce or eliminate the dealer's advantage. In the latter case, the game can be adjusted such that the dealer's expected return is even. Further, some jurisdictions do not allow any payout greater than even money, so that embodiments where there is any type of payout greater than 1:1 could not be used in such jurisdiction.

In one embodiment, the player is required initially to bet a plurality of units in square 2, for example two or three units, and a single unit in each of squares 3 and 4. As will be described in more detail below, the player may also make a bet of, for example, one unit in the "high hand" bet square 5. In brief, by placing a bet in the high hand bet square 5, the player is given a chance to win a payout on the player's eventual final hand, even if the player folds during one of the betting rounds to be described below.

In one embodiment of the present invention, a "permanent" card 17 is part of the dealer's hand 16. It is referred to as a permanent card because the card is specified in advance and is always present as part of the dealer's hand (that is, it is not randomly dealt each game as are the other cards). In one embodiment, permanent card 17 is an "ace of all suits."

That is, this card can be used by the dealer as an ace of any suit in order to make a hand needing an ace of a particular suit, such as may be the case in flushes or straight flushes. In other embodiments using a permanent card 17, other cards can be used as the permanent card 17, including other special cards having defined properties, a wild card (i.e. a card that may substitute for any card in the deck), a duplicate of a standard card, or one of the cards of the deck, such as an ace. One aspect of utilizing a card such as the ace of all suits, another card with defined properties, a duplicate of a standard card, or a wild card as permanent card 17 is that all of the standard cards remain available for play.

In any embodiment utilizing a permanent card 17, commercial gaming establishments may find it desirable to employ a decorative card such as a laminated card, tile card, etc. and to affix the card to the table in some manner. In any embodiment using one of the cards of the deck as the permanent card 17, the chosen card is removed from the deck prior to an initial shuffle and is either placed face up as the permanent card 17, or removed from the deck and placed aside if the foregoing decorative card is used. The remaining cards are then shuffled and dealt as described immediately below.

It will be understood that the cards may be dealt in any desired order, and each card may be dealt at any time prior to its being played. Each player is dealt two cards face down (not shown), and the dealer is dealt a face down card 18 in addition to the permanent ace 17. In addition five common cards 21 through 25 are dealt in common area 20. As mentioned above, the common cards 21 through 25 are common to all players and to the dealer. Common cards 21 through 23 constitute the "flop" 26 which means that these cards are all dealt or turned over at one time (i.e., without the opportunity for additional wagering or folding between turning of the individual cards in the flop) as will be described in more detail immediately below.

In a preferred embodiment, the game starts with each player viewing his or her two cards to determine what action to take. The player may stay and so indicate to the dealer. Alternatively, the player may fold. If the player folds at this point, the player forfeits, in one embodiment, one unit from square 2. The remaining unit(s) in square 2, the unit in square 3 and the unit in square 4 are returned to the player. If a player who has folded had placed a bet in high hand bet square 5, that bet remains and the player's cards may be placed face down under the bet in square 5.

Next, the cards of the flop 20—i.e. cards 21, 22, and 23—are dealt face up, or if previously dealt face down are now turned over (so as to be face up). Each player again evaluates his or her hand, which now consists of the player's two face down cards together with the three common cards 21, 22 and 23, against the dealer's hand consisting of the permanent ace 17, face down card 18 and the three common cards 21, 22 and 23. The player may stay and so indicate to the dealer. Alternatively, the player may fold at this point, in which case the player forfeits all units in square 2. The remaining unit in square 3 and unit in square 4 are returned to the player. Again, if a player who has folded had placed a bet in high hand bet square 5, that bet remains and the player's cards may be placed face down under the bet in square 5. In a further embodiment of the present invention, each player has the further option of increasing the player's bet by, for example placing an additional unit or more in square 3. In this embodiment, the maximum increase may be set by the house in advance, at for example, a doubling or tripling of the initial bet in square 3.

After the flop has been dealt or turned face up and the above-described player action has been completed, card 24 is then dealt face up or turned face up if previously dealt face down. The individual cards 24 and 25 may have fanciful names such as 4th Street$^{SM}$ for card 24 and River$^{SM}$ for card 25. Once again, each player evaluates the player's hand against the dealer's. The hands now consists of the two face down cards (for each player)/permanent ace 17 and card 18 (for the dealer) together with the three common cards of the flop 20 and 4th Street card 24. The player may stay and so indicate to the dealer. Alternatively, the player may fold at this point, in which case the player forfeits all units in square 2, plus the unit in square 3. The remaining unit in square 4 is returned to the player. Again, if a player who has folded had placed a bet in high hand bet square 5, that bet remains and the player's cards may be placed face down under the bet in square 5. In a further embodiment of the present invention, each player has the further option of increasing the player's bet by, for example placing an additional unit or more in square 4. Once again, the maximum increase may be set by the house in advance, at for example, a doubling or tripling of the initial bet in square 4.

Next, the dealer deals or turns face up River card 25 and the dealer's face down card 18. The final hands now consists of the two face down cards (for each player)/permanent ace 17 and card 18 (for the dealer) together with the three common cards of the flop 20, 4th Street card 24 and River card 25. The dealer determines winning and losing hands by using the earlier mentioned standard poker hand rankings to compare each player's hand to the dealer's hand, utilizing the best five cards in each hand. A hand that has beaten the dealer's hand will be referred to herein as a "winning hand."

The bets in all of squares 2 through 4 are removed from all losing hands. Each winning hand is paid out, in one embodiment, an amount equal to the total amount bet in each of the squares 2 through 4, including any increases in the wager during the game as described earlier.

In one embodiment of the present invention, a winning hand (or alternatively any hand (winning or not) that remains in play until the end of the game) may also win a "bonus" payout based upon the player's hand according to a payout table that may, for example, specify a return as a ratio of the player's bet. The bonus can start at any level of hand (for example, bonus payouts may be paid for hands of three of a kind or better) and may increase for increasing level of hands. The payout can be based on any portion or all of the player's bet (for example, the bonus payout can be based on only the original bet, or on the original bet and any increases during the game).

Additionally, in one embodiment, each folded hand that had a high hand bet placed in square 5 (referred to as a "high hand bet winning hand") is paid out according to a payout table, which may be similar to the above described bonus payout table for winning hands that have not folded, but may have different payout ratios, if desired. As with the bonus payout, there is preferably some minimum level of hand at which the payout starts, and the ratio may increase for higher level hands. In an embodiment having the high hand bet, there may be an additional requirement that the player utilizes at least one of the player's individual cards to make the winning hand (i.e. the hand is not formed solely from the common cards) for a payout. If desired, this requirement may be imposed for some payouts (e.g. higher level winning hands such as full house or better) but not others. Furthermore, if desired, an additional requirement may be imposed that the player must beat the dealer's hand, in addition to achieving one of the hands specified on the payout table.

In addition, in one embodiment of the present invention a player who stays in all the way through the final card (i.e. the River card 25 in the above described embodiment) but loses to the dealer's hand (an "unfolded losing hand" herein), may be paid for achieving a specified level of hand according to a payout table, which may be different from the other payout tables described above. The variations and additional requirements described above for the high hand bet payout may also be used in conjunction with the unfolded losing hand payout.

Note that in the present invention, the players' hands are not compared to one another, thus providing the player versus dealer rather than player versus player action as described earlier. Further, note that the player may take actions such as folding or increasing the bet without reference to other player's hands or other player's actions. Rather, the player need only consider the player's own hand and the dealer's hand, which in essence acts as a reference hand since the dealer does not make any decisions regarding the dealer's hand. In addition to removing the elements of bluffing and reading other players which, as described earlier may be intimidating, the player may take action without regard to the decisions of other players. This is in contrast to traditional poker where the player may be forced to either fold or increase the bet based upon another player's bet or raise. Similarly, in traditional poker a player may attempt to increase the wager by means of a bet or raise, but in such case the player must depend on other players accepting the increase by calling the bet or raise.

As one alternative, the 4th Street card 24 and River card 25 may be dealt face up (or turned face up) simultaneously. That is, these cards may constitute a second flop. Play proceeds in a manner similar to that described in the above embodiment after the turning of 4th Street card 24. In this embodiment, it is typically desirable to have a round of betting after the two cards 24 and 25 are simultaneously dealt or turned face up and prior to revealing the dealer's card 18. Thus, in one embodiment, after cards 24 and 25 are simultaneously dealt, the player may stay and so indicate to the dealer. Alternatively, the player may fold, in which case the player forfeits all units in square 2, plus the unit in square 3. The remaining unit in square 4 is returned to the player. Optionally, each player may again be given the opportunity to increase the player's bet by, for example placing an additional unit or more in square 4. As before, the maximum increase may be set by the house in advance, at for example, a doubling or tripling of the initial bet in square 4. Alternatively, in an embodiment where cards 24 and 25 are dealt or turned face up simultaneously, play may proceed in a manner similar that described above after the dealing of card 25—i.e. the dealer's card 18 is also revealed, and winners and losers are then determined without any further player action. In such a case, square 4 would not be required.

It will be appreciated that additional numerous modifications may be made to the embodiments described herein. For example, some variation of the standard poker deck may be used. For example, as described earlier a card with certain specified properties (such as the ace of all suits), or one or more wild cards may be used in the present invention. If desired, some cards of a standard deck may be removed, and if desired one or more cards of a standard deck may be duplicated. Decks of cards having such variations are referred to as "substantially" standard decks herein. Additionally, although standard rankings have been described, payouts can be made for non-standard hand rankings as well. For example, some known variations include allowing a straight to go "around the corner" e.g. Q - K - A - 2 - 3, which hand ranks just below a straight; four card straight flushes ranking just below four of a kind, and so on. See, for example, *Poker is the Name of the Game*, by Walter Gibson, Harper and Row, 1974, pp. 10–11. Such rankings are referred to as "substantially" standard poker rankings herein.

In some embodiments, the permanent card 17 can be eliminated, so that the dealer's hand comprises two face down cards randomly dealt each game. In this case, one or both of the dealer's face down cards can be shown at any point in the game. For example, one may be turned face-up at the very beginning of the game. Amounts bet in each square, amounts forfeited versus amounts returned upon fold, amounts that the bet can be increased, as well as the stage in the game that such occurs can be varied as well. Although the game has been described in conjunction with the betting squares 2–5, such squares are not necessary and the same general action can be carried out by defining portions of a total bet that can be returned, increased, etc. at various stages of the game. If desired, between the turning of the River card 25 and dealer's card 18, an additional "round" can be had—i.e., the player may be given an additional opportunity to increase the bet some amount, or fold and have some portion of the bet returned.

Other variations may be made. For example, the number of cards dealt to the dealer, to each player, as common cards or as part of the flop may be varied. In general, although exemplary embodiments and variations are described, it will be appreciated that the number of points in a game at which a player is provided with one or more possible actions (e.g. one or more of opportunity to forfeit and receive return, optional increase, required increase), can be increased or decreased as desired. In general, it will be appreciated that the payout amounts of the present game can be set at an amount that achieves an acceptable margin, while allowing for a sufficient payout amount and frequency to maintain player interest. Payout amounts to achieve such margin for any given embodiment can be determined using standard mathematical methods well known to those of skill in the art of determining odds and margin for wagering games. Thus, the specific amounts shown are for exemplary embodiments, and should not be considered as limited to any specific embodiment.

Figure 5:
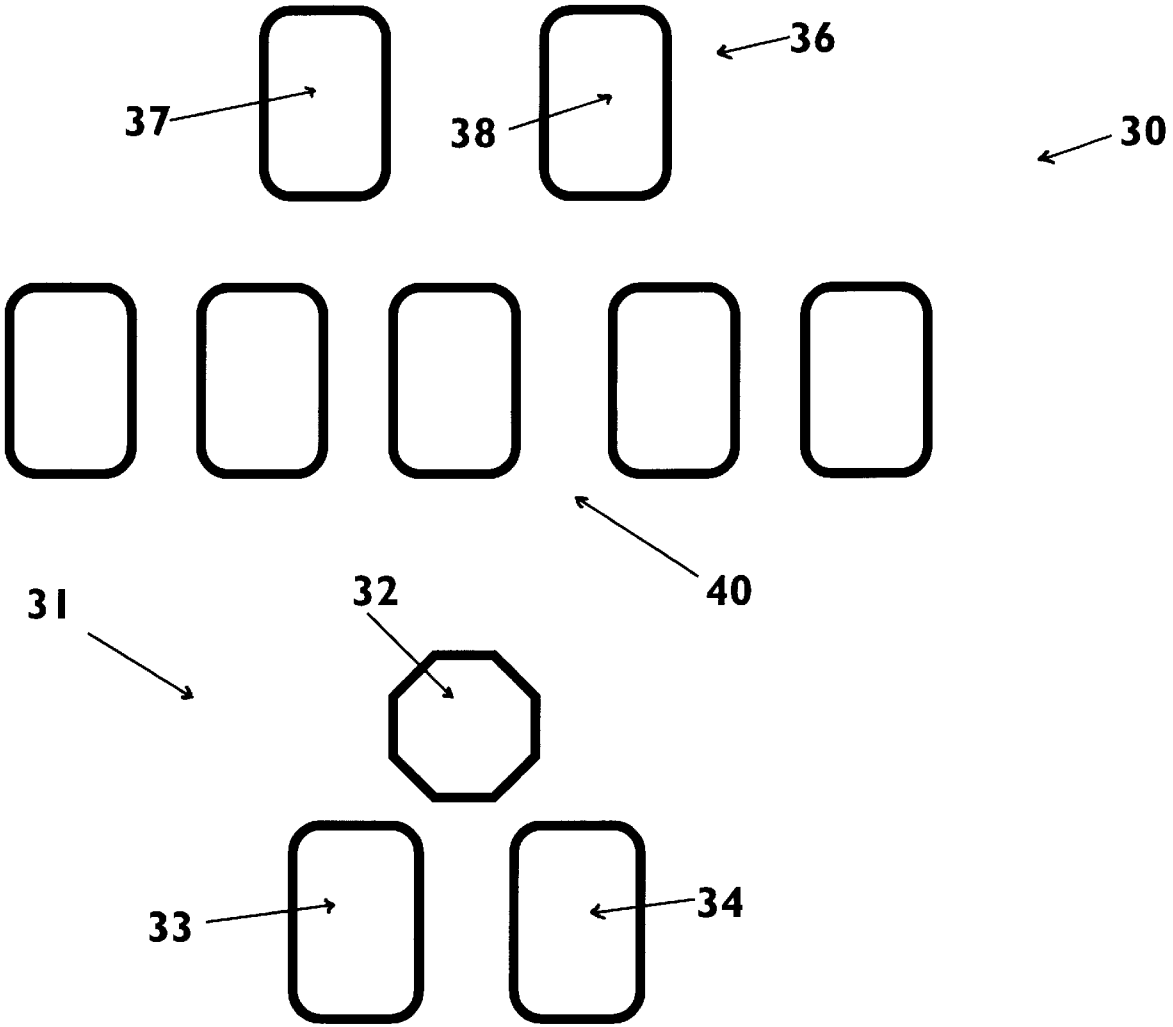
FIG. 5 shows an illustration of a portion of the playing field in a further preferred embodiment of the present invention.

A further exemplary embodiment of the present invention and variations thereof are described in conjunction with FIG. 5. In the embodiment shown therein, the common cards may consist solely of a single flop 40 comprising a plurality of common cards. In this embodiment, the player may place a specified number of unit(s) in square 32 (e.g. the ante) and a specified number of unit(s) in square 33 (e.g. the bet) prior to receiving e.g. two face down cards. Although only one player betting position is shown, there may be a plurality of such positions. As before, the dealer's hand 36 may consist of two cards 37 and 38, one of which may be a permanent card 37 as described above. After viewing the two face down cards, the player may forfeit and lose the ante, but have one or more (e.g. all) of the units placed in square 33 returned. Optionally, the player may increase the wager, for example by placing up to an additional specified number of unit(s) in square 34. Next a flop 40 of e.g. five cards are dealt or turned face up. In a preferred embodiment, the dealer's face down card 38 is next turned face up and winners and losers are determined. Alternatively, prior to turning or dealing the dealer's card, a further opportunity to forfeit (and receive a return of a designated portion of the wager) or to increase the bet (either optional or required) may be provided.

Some specific variations of the embodiment described immediately above will illustrate exemplary magnitudes of the house advantage and the effect of varying some of the features of game on that advantage. The following rules apply to all exemplary embodiments discussed in conjunction with FIG. 5: the dealer has a permanent ace 17 of a particular suit e.g. spades, taken from the deck; two face down cards (not shown) are dealt to each player; and the player places an ante of one unit in square 32 and a bet of two units in square 33. Further, none of the following exemplary embodiments use the previously described high hand bet, although this feature could be added if desired. All odds have been determined assuming the player pursues an optimum strategy. Should players utilize a strategy that is less than optimum, the house advantage will be greater than stated.

In one embodiment, after viewing the two face down cards, the player may forfeit, lose the ante in square 32 but receive the 2 units in square 33 back. Alternatively, the player may stay in and optionally increase the bet by placing up to 8 units in square 34. Next, a five card flop of five common cards 40 are dealt face up, and the dealer is dealt a second card 38. Winners and losers are determined using standard poker rankings, with winners (which in this embodiment and the following variations includes players whose hands tie the dealer's hand) being paid even money on their total wager (all amounts placed in squares 32, 33 and 34—e.g. ante plus bet plus any increases) as described previously. In this particular embodiment there is no bonus payout or payout for unfolded losing hands. In such an embodiment the house advantage is approximately 9%. If this is varied by keeping all of the foregoing rules except that the maximum a player may increase is 6 units instead of 8, the house advantage increases to approximately 11%.

A further variation is as follows: After viewing the two face down cards, the player may forfeit, lose the ante in square 32 but receive the 2 units in square 33 back. However, if the player has one or two of a specified card in the player's hand, e.g. a two of any suit, the player may fold and win even money on the ante (i.e. the player has the ante of one unit returned and receives an additional one unit) and receive the bet back (as opposed to receiving only the bet back as occurs if the player folds without the specified card in the player's hand). Alternatively, the player may stay in and optionally increase the bet by placing up to 8 units in square 34. Next, a five card flop of five common cards 40 are dealt face up, and the dealer is dealt a second card 38. Winners and losers are determined using standard poker rankings, with winners being paid even money on their total wager. In this particular embodiment there is no bonus payout or payout for unfolded losing hands. In such an embodiment the house advantage is approximately 2%. If this is varied by keeping all of the foregoing rules except that: i) a player who forfeits with two of the specified cards—i.e. two deuces—receives a payout of 2:1 on the ante rather than even money (i.e. the player has the ante of one unit returned and receives an additional two units) as well as return of the bet, and ii) the maximum that a player may raise is 6 units rather than 8, the house advantage is approximately 4%.

Yet a further variation proceeds as follows: After viewing the two face down cards, the player may forfeit, lose the ante in square 32 but receive the 2 units in square 33 back. However, if the player has one of a specified card in the player's hand, e.g. a two of any suit, the player may fold and win even money on the ante and receive the bet back. If the player folds with two of the specified cards—i.e. two deuces, the player receives a payout of two to one on the ante and receives the bet back. Alternatively, the player may stay in and optionally increase the bet by placing up to 8 units in square 34. Next, a five card flop of five common cards 40 are dealt face up, and the dealer is dealt a second card 38. Winners and losers are determined using standard poker rankings, with winners being paid even money on their total wager. Furthermore, in this embodiment, any player who stays in the game (win or lose) is paid a bonus payout based on the ante, for specified hands as follows: four of a kind—20:1; straight flush—200:1; royal flush—1000:1. For winners, this amount is paid in addition to the even money payout on the total wager. In this embodiment, there is no high hand bet, and the house advantage is approximately −1% (i.e. an approximate 1% player advantage).

In yet another embodiment, after viewing the two face down cards, the player may forfeit, lose the ante in square 32 but receive the 2 units in square 33 back. However, if the player has one of a specified card in the player's hand, e.g. a two of any suit, the player may fold and win even money on the ante and receive the bet back. If the player folds with two of the specified cards—i.e. two deuces, the player receives a payout of two to one on the ante and receives the bet back. Alternatively, the player may stay in and optionally increase the bet by placing up to 6 units in square 34. Next, a five card flop of five common cards 40 are dealt face up, and the dealer is dealt a second card 38. Winners and losers are determined using standard poker rankings, with winners being paid even money on their total wager. Furthermore, in this embodiment, any player who stays in the game (win or lose) is paid a bonus payout based on the ante, for specified hands as follows: four of a kind—6:1; straight flush—30:1; royal flush—300:1. For winners, this amount is paid in addition to the even money payout on the total wager. In this embodiment the house advantage is approximately 3%.

As mentioned earlier, in some jurisdictions, payouts greater than 1:1 are not allowed. In such cases, the above embodiments having the bonus payout or the 2:1 payout on the pair of deuces could not be used. Also as described earlier, in such jurisdictions it is often desirable to reduce the dealer's advantage. This can be done, for example, by using an embodiment that provides for a payout of even money the ante as well as return of the bet if the player has one or more e.g. deuces in the player's hand upon forfeit. The dealer's advantage can also be reduced by increasing the amount that the player may raise. For example, as noted above, where the player antes one unit, bets two units, may raise up to 8 units, and wins even money on the ante as well as return of the bet upon forfeit with one or two deuces, the house advantage is approximately 2%. By increasing the permissible amount a player can raise to 9 units, the house advantage drops to approximately 1%. By increasing the permissible amount a player can raise to 10 units, the house advantage drops to approximately even.

The various illustrative embodiments of the invention described herein, as well as other variations that will be obvious of one of skill in the art upon reading the present specification, provide considerable flexibility in designing the game. There are numerous means by which the level of player activity and involvement can be varied. For example, the embodiments having the above described bonus payout, the high hand bet, and/or payouts for unfolded losing hands can be utilized to increase the number of ways a player can win. As another example, the number of points during the game at which a player may fold and have a portion of the bet returned or at which the player may increase the bet may be increased or decreased.

In general, one or more desired features can be emphasized to achieve the desired type of game. Typically, there will be some tradeoff in one or more other aspects of the game to achieve an acceptable margin. In general, however, each of the various features and alternative embodiments described herein can be used as "knobs" to fine tune the margin and the action of the game. For example, a game that has more ways of winning can compensate by having lower payouts, and/or having a higher minimum level of hand returning a specified type of payout, and/or reduced opportunity for increasing the bets. Similarly, a high payout game may, for example eliminate or limit one or more of: opportunity to increase the bet; bonus payout on winning hands; payout for unfolded losing hands; separate high hand bet; amount of original bet returned upon fold; etc.

The foregoing flexibility may be useful to, for example, ensure that the desired house advantage corresponds to the way the game is typically played. In particular, while the house advantage may vary, it is desirable that it not become too excessive as the player would lose money very quickly and hence lose interest in the game. Of course, some house advantage will typically be required, and the advantage must be calculated based upon use of the optimum strategy by the player, even if many players fail to use it, so that the game can't be "beat" by players who do use the optimum strategy.

Unfortunately, if less than an optimum strategy is played, the house advantage may become excessive. The house advantage in the above-described embodiments was based upon an optimum strategy wherein it is to the player's advantage to remain in the game for most of all possible combinations of the player's initial two cards. Further, the optimum strategy calls for raising on a many occasions, and when raising is to the player's advantage, the raise should be for the maximum amount allowed. Thus, the player may fail to play close to the optimum strategy by folding too frequently, or by not raising the maximum.

If desired, the player can be forced to play closer to an optimum strategy by not providing for any forfeit with return of the bet—in effect forcing the player to remain in the game rather than folding. In such embodiments, one exception to the no fold rule is to allow for a fold with one or more of a predetermined card (e.g. two of any suit) where the player receives a return based on the ante and/or bet for the predetermined card, because the optimum strategy is always to fold the hand in embodiments having this feature.

Additionally, if players have a tendency to raise less than the maximum, then it may be desirable to provide ways of decreasing the house advantage other than by increasing the maximum amount a player can raise. There are many ways to decrease the house advantage. For example, the bonus for certain hands can extend to lower hands than described above, and/or can be increased. Moreover, the bonus can be paid even for folded hands if desired. Embodiments using the payout on the predetermined card may be used to decrease the house advantage, and can have a greater payout ratio (where allowed) and/or the payout can be based on a greater amount than the ante alone—e.g. can be based on the bet instead of the ante or can be based upon the bet plus the ante. An additional means to adjust the odds is to vary the payout based upon the particular suit(s) of the predetermined card—e.g. red deuces receive a payout based on the bet plus ante while black deuces receive a payout based on the bet alone or ante alone. These variations are useful to adjust the odds where the payout must be even money, as they provide a way for a greater payout without using a greater than 1:1 return. Of course where greater than 1:1 payout is allowed, this variation can still be used, and/or the payout ratio can be made greater than 1:1 for a particular suit(s) of the predetermined card.

Some further embodiments of the present invention will illustrate the foregoing. Once again, the following embodiments utilize the rules of play described above in relation to FIG. 5, except as otherwise noted. In one embodiment, the player antes one unit, bets two units, and may fold, raise or stay after the first two cards (as in the previous embodiments). However, the maximum raise is 5 units, and if the player folds with one or two deuces, the player wins even money on the bet of two units (and has the ante returned). This embodiment has a house advantage of approximately 0.3%. This embodiment is useful where payouts of greater than even money are not allowed.

In a further embodiment, the maximum raise is 3. Unlike previous versions, the player is not given the option to fold after two cards, unless the player has at least one deuce. The player wins even money on the ante for folding with one deuce, and wins 5:1 on the ante for folding two deuces (in both cases also receiving a return of the bet). Further a bonus of 5:1 is paid on a full house; 10:1 on four of a kind; 30:1 on a straight flush; and 300:1 on a royal flush. In this embodiment, the house advantage is approximately 2.2%.

In yet a further embodiment, the maximum raise is again 3, and like the immediately preceding embodiment the player is not given the option to fold after two cards, unless the player has at least one deuce. The player wins even money on the ante for folding with one deuce, and wins 10:1 on the ante for folding two deuces (in both cases also receiving a return of the bet). Further a bonus of 6:1 is paid on a full house; 12:1 on four of a kind; 50:1 on a straight flush; and 250:1 on a royal flush. In this embodiment, the house advantage is approximately 0.5%. This embodiment may be particularly advantageous in e.g. player pooled games as it is typically desirable to keep the house advantage smaller as compared with games where the house banks the game. In both this and the preceding embodiment, the bonus is paid on all hands that remain in the game, winning or not. However, the bonus is not paid on hands that folded with one or two deuces.

It will be appreciated that the foregoing embodiments are illustrative of some of the types of variations that may be made. As mentioned earlier, one of skill in the art knows standard methods of determining odds based upon a given set of rules. The foregoing embodiments give guidance as to the magnitude and direction of the change in the house advantage accompanying a change in the various features (such as amount of maximum raise, presence and amount of payout for having one or two predetermined cards in the player's initial hand, hands winning a bonus payout and amount of the bonus, etc.). Thus numerous variations may be made to the foregoing. With respect to the bonus, in general, the bonus amounts will typically be in the ranges of approximately: 1:1–5:1 for three of a kind; 1:1–10:1 for a straight; 1:1–15:1 for a flush; 1:1–25:1 for a full house; 2:1–50:1 for four of a kind; 5:1–250:1 for a straight flush; and 100:1–1000:1 for a royal flush. Of course, the bonus may be outside these ranges if desired. For a particular embodiment otherwise having the same or similar features, it will typically be desired to keep the bonus within approximately plus or minus 50% of the ratios given herein to keep the house advantage within a desired range. Also, the foregoing are desired ranges where there is an ante of one unit and a bet of two units. The ratio may vary when using different wagering schemes, or where the payout is based upon a different portion of the wager.

With respect to payout on a predetermined card (such as a deuce), it will typically be desired for a single predetermined card for a payout ratio based upon the ante in the range of approximately 1:1–5:1, and for two of the predetermined cards in the range of approximately 1:1–50:1. The payout may be varied outside these ranges. Again, the foregoing are desired ranges where there is an ante of one unit and a bet of two units. The ratio may vary when using different wagering schemes, or where the payout is based upon a different portion of the wager.

Figure 4:
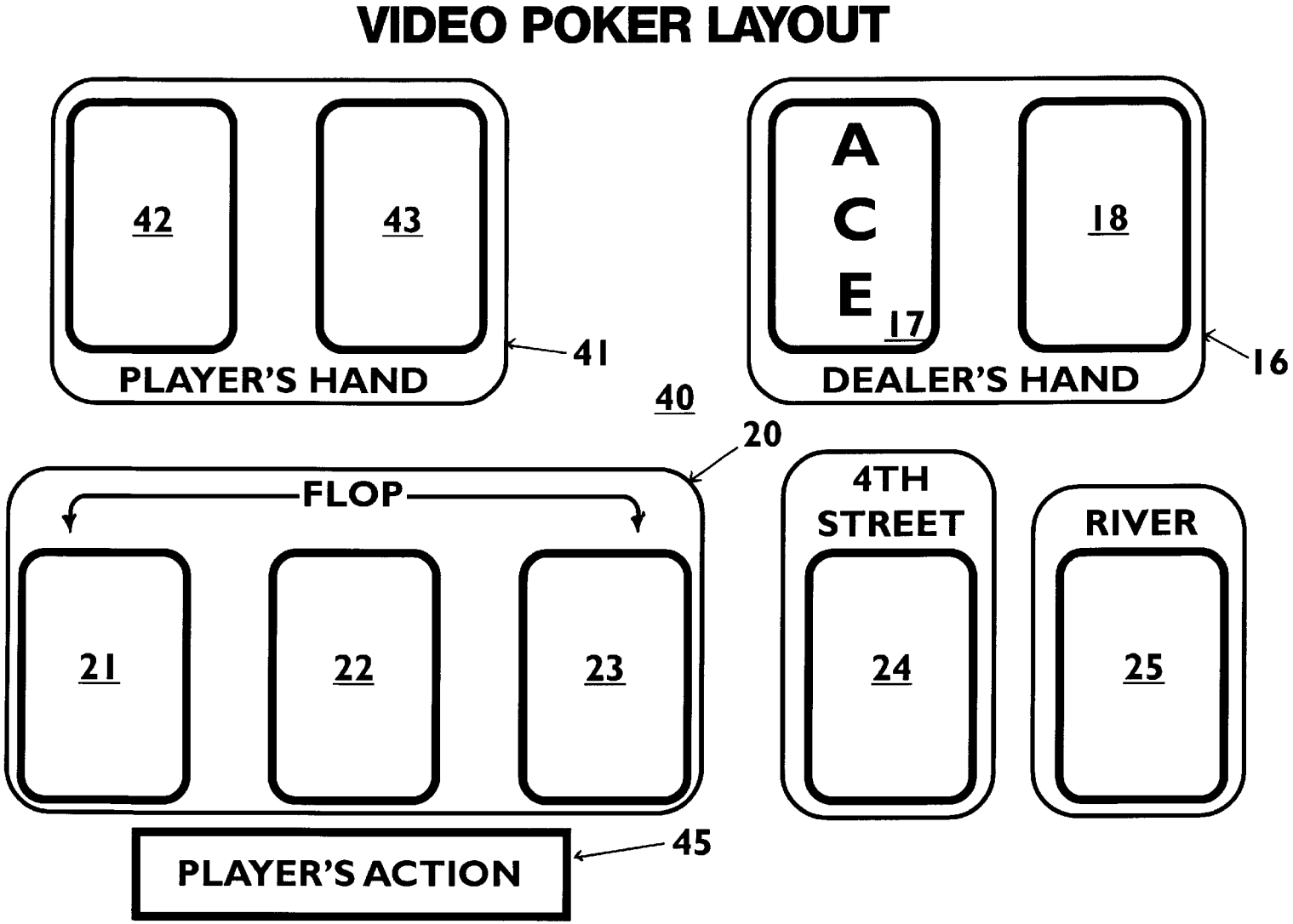
FIG. 4 shows a layout of an electronic embodiment of the present invention.

The present invention can be played as a video game. As with the live game, the wager in the video game may be money, or may be points. Therefore the present invention may be implemented on video systems such as those seen in casinos having video poker, or may be implemented on simple, hand held recreational devices. It will be appreciated that one of skill in the art of video wagering games can use known methods to implement the present invention as a video game, including designing computing means and display means in accordance with the teachings of the present invention. As shown in FIG. 4, a layout 40 displayed on video screen 40 comprises the flop 20, 4th Street card 24, River card 25, and Dealer's hand 16. Additionally shown is player's hand 41 comprising cards 42 and 43. The player action portion of the display may have elements similar to squares 2 through 5 described earlier. In addition, this section may include instructions or means for player action such as touch-screen buttons. For example this section may provide instructions or means for the player to place initial bets including the high hand bet, and to stay, fold, increase the bet, et cetera. The video game of the present invention may use any embodiment of the present invention. In fact, using known methods, the video version of the present invention may provide means to allow the player to select certain options, so as to tailor the game to the player's liking. For example, a player may choose the option of increasing a payout at the expense of some other feature as described generally above.

Obviously, in the video game the player's hand 41 is dealt face up. In contrast, it is generally desirable to deal the players' hands face down in a multi-player "live" game, because the ability of one player to see another player's cards provides each player with a significant amount of information, thus increasing the player's odds. Even in a live game the players' hands may be dealt face-up, with appropriate adjustment elsewhere, although this generally is not likely to be desirable. However, in a video game it may be desirable to so adjust the game to enable multi-seat video games.

Although the present invention has been described in terms of specific embodiments thereof, it will be appreciated that numerous novel aspects of the present invention, including the permanent card, player versus dealer play, ability of a player to take actions such as folding or increasing the bet without reference to other player's cards or other player's actions, the bonus payout, the high hand bet, and the unfolded losing hand payout, may be utilized other than as described specifically herein and in conjunction with other types of card games than described herein. Thus, while the present invention has been described in terms of specific embodiments thereof, it will be appreciated that present invention is not to be so limited and that numerous variations of the present invention will be apparent to one of skill in the art upon reading the present disclosure.

What is claimed is:

1. A method of playing a card game comprising the steps of:

specifying a first card before the cards are dealt, said first card having a predetermined known value;

dealing a hand comprising at least one card to at least one player;

dealing a hand comprising at least one card to a dealer;

dealing at least one common card, said common card being common to said dealer and to said at least one player;

wherein said dealer's hand comprises said first card.

2. The method as described in claim 1 wherein said first card is an ace.

3. The method as described in claim 1 wherein said player places a wager, and wherein at at least one point during said card game said player is given at least one option selected from the group consisting of:

i) folding said player's hand and receiving at least a portion of said wager back;

ii) folding said player's band and being relieved of an additional wager required to stay in said game;

iii) increasing said wager; and, iv) any combination of two or more of options i, ii, and iii.

4. The method as described in claim 3 wherein said at least one point comprises a point selected from the group consisting of:

i) after said step of dealing said at least one card to said at least one player and prior to said step of dealing at least one common card;

ii) after said step of dealing at least one common card;

iii) after dealing a plurality of common cards during said step of dealing at least one common card; and iv) any two or more of i, ii, and iii.

5. The method as described in claim 3 wherein a player may place an additional wager, and wherein said player may win a return on said additional wager if said player's hand achieves an specified level irrespective of whether said player has folded.

6. The method as described in claim 3 wherein if said player does not fold during said game, said player receives a payout based upon the level of hand as determined from a determined ranking of hands.

7. The method as described in claim 1 wherein a plurality of common cards are dealt simultaneously during said step of dealing said at least one common card.

8. The method as described in claim 1 wherein said player is determined to be a winner by a method comprising determining if said player's hand is a higher hand than said dealer's hand according to a determined ranking of hands.

9. The method as described in claim 8 wherein said deck is substantially a standard deck of poker cards, and wherein substantially standard poker rankings are used for said method of determining if said player is a winner.

10. The method as described in claim 1 wherein a plurality of players participate, and wherein each of said players is determined to be a winner individually.

11. The method as described in claim 1 wherein said player places a wager, said wager comprises an ante and a bet, and wherein if said player forfeits, said player receives said bet back.

12. The method as described in claim 1 wherein said player places a wager and wherein if at least one of said at least one cards dealt to said player is a predetermined card, said player wins a first amount based upon at least a portion of said wager.

13. The method as described in claim 12 wherein at least two cards are dealt to said player, and wherein if two of said at least two cards dealt to said player are said predetermined card, said player wins a second amount based upon at least a portion of said wager, said second amount greater than said first amount.

14. The method as described in claim 1 where said player places a wager, and wherein said player receives a payout for achieving a specified hand, said payout being a ratio based upon at least a portion of said wager, said payout given for one or more of the following of said specified hands, said ratio in the range of approximately 1:1–25:1 for a full house, 2:1 to 50:1 for four of a kind, 5:1 to 250:1 for a straight flush, and 100:1 to 1000:1 for a royal flush.

15. The method as described in claim 14 wherein said wager comprises an ante and a bet, and wherein said portion comprises said ante.

16. A device comprising means to perform the method as described in claim 1, said device having a display to display information regarding said game, computing means to perform said method in conjunction with player input, and interface means for said player to indicate said input.

17. The device as described in claim 16 further comprising means for placing a wager, and wherein said device comprises means for said player to take an action at at least one point during said game selected from the group consisting of:

i) folding said player's hand and receiving at least a portion of said wager back;

ii) folding said player's hand and being relieved of an additional wager required to stay in said game;

iii) increasing said wager; and, iv) any combination of two or more of options i, ii, and iii.

18. The device as described in claim 17 wherein said at least one point is a point selected from the group consisting of:

i) after said step of dealing said at least one card to said at least one player and prior to said step of dealing at least one common card;

ii) after said step of dealing at least one common card;

iii) after dealing a plurality of common cards during said step of dealing at least one common card; and iv) any two or more of i, ii, and iii.

19. A storage device storing instructions which, when executed by processing means cause said processing means to perform the method described in claim 1.

20. A method of playing a card game comprising the steps of:

dealing a hand comprising at least one card to each of a plurality of players, said at least one card being a different card for each of said plurality of players;

dealing a hand comprising at least one card to a dealer;

dealing at least one common card, said common card being common to said dealer and to said players, comparing the dealer's hand with each of the players' hands wherein the same at least one common card must be used by each of said plurality of players in determining each of said players' hands when comparing each of the players' hands to the dealer's hand;

determining if each of said players is a winner individually.

21. The method as described in claim 20 further comprising specifying a first card, and wherein said dealer's hand comprises said first card.

22. The method as described in claim 21 wherein said specified card is an ace.

23. The method as described in claim 20 wherein said deck is substantially a standard deck of poker cards, and wherein substantially standard poker rankings are used for said step of determining if said player's hand is a winning hand.

24. The method as described in claim 23 wherein each player must use at least one of said at least on common cards in said player's hand for said step of determining if said player's hand is a winning hand.

25. The method as described in claim 20 wherein said player places a wager, and wherein at at least one point during said card game said player is given at least one option selected from the group consisting of:

i) folding said player's hand and receiving at least a portion of said wager back;

ii) folding said player's hand and being relieved of an additional wager required to stay in said game;

iii) increasing said wager; and, iv) any combination of two or more of options i, ii, and iii.

26. The method as described in claim 25 wherein said at least one point comprises a point selected from the group consisting of:

i) after said step of dealing said at least one card to said at least one player and prior to said step of dealing at least one common card;

ii) after said step of dealing at least one common card;

iii) after dealing a plurality of common cards during said step of dealing at least one common card; and iv) any two or more of i, ii, and iii.

27. The method as described in claim 20 wherein a plurality of common cards are dealt simultaneously during said step of dealing said at least one common card.

28. The method as described in claim 20 wherein said method is performed on a device having a display to display information regarding said game, computing means to perform said method in conjunction with player input, and interface means for said player to indicate said input.

29. A storage device storing instructions which, when executed by processing means cause said processing means to perform the method of claim 20.

30. A method of playing a card game comprising the steps of:

specifying a first card before the cards are dealt, said first card having a predetermined known value;

dealing a hand comprising at least one card to at least one player;

dealing a hand comprising at least one card to a dealer;

wherein said dealer's hand comprises said first card.

31. The method as described in claim 30 wherein said player places a wager, and wherein at at least one point during said card game said player is given at least one option selected from the group consisting of:

i) folding said player's hand and receiving at least a portion of said wager back;

ii) folding said player's hand and being relieved of an additional wager required to stay in said game;

iii) increasing said wager; and, iv) any combination of two or more of options i, ii, and iii.

32. The method as described in claim 30 wherein said player is determined to be a winner by a method comprising determining if said player's hand is a higher hand than said dealer's hand according to a determined ranking of hands.

33. The method as described in claim 32 wherein a plurality of players participate, and wherein each of said players is determined to be a winner individually by said method for determining.

34. The method as described in claim 30 where said player places a wager, and wherein said player receives a payout for achieving a specified hand, said payout being a ratio based upon at least a portion of said wager, said payout given for one or more of the following of said specified hands, said ratio in the range of approximately 1:1–25:1 for a full house, 2:1 to 50:1 for four of a kind, 5:1 to 250:1 for a straight flush, and 100:1 to 1000:1 for a royal flush.

* * * * *